United States Patent [19]

Reed

[11] Patent Number: 4,899,705

[45] Date of Patent: Feb. 13, 1990

[54] TRAMMEL CRANK ENGINE

[76] Inventor: Patrick J. Reed, 321 Brookdale Dr., League City, Tex. 77573

[21] Appl. No.: 239,225

[22] Filed: Sep. 1, 1988

[51] Int. Cl.[4] ..... F02B 75/32

[52] U.S. Cl. ..... 123/197 AC; 123/90.6; 79/62

[58] Field of Search ..... 123/197 R, 197 AB, 197 AC, 123/90.6; 74/62

[56] References Cited

U.S. PATENT DOCUMENTS

| | | | |
|---|---|---|---|
| 4,363,299 | 12/1982 | Bristol | 123/197 AB |
| 4,466,403 | 8/1984 | Menton | 123/197 AC |
| 4,485,768 | 12/1984 | Heniges | 123/197 R |
| 4,512,291 | 4/1985 | Kirk | 123/197 AC |
| 4,543,919 | 10/1985 | Carson | 123/197 AC |
| 4,682,569 | 7/1987 | Stiller et al. | 123/197 AC |
| 4,736,717 | 4/1988 | Fujikceuce et al. | 123/90.6 |

FOREIGN PATENT DOCUMENTS

| | | | |
|---|---|---|---|
| 581575 | 10/1946 | United Kingdom | 74/62 |

*Primary Examiner*—Noah P. Kamen

*Attorney, Agent, or Firm*—Norman B. Rainer

[57] ABSTRACT

An improvement in a four cycle internal combustion engine is provided whereby the crankshaft rotates at half the velocity normally encountered in conventional piston driven engines. In particular, the crankshaft undergoes just one complete revolution for every two complete cycles of the piston. By virtue of its reduced rotational velocity, the crankshaft is more easily geared to the rotational velocities of wheels of an automobile, and permits use of a simple valve-lifting mechanism. The improvement involves the interaction of each piston with a trammel crank mechanism.

1 Claim, 5 Drawing Sheets

TRAMMEL CRANK ENGINE

BACKGROUND OF THE INVENTION

This invention relates to internal combustion engines, and more particularly concerns an improved four cycle, poppet valve type piston driven internal combustion engine.

Four cycle piston driven internal combustion engines are generally characterized by having at least one piston which reciprocates within a combustion cylinder and drives a crankshaft in a rotary manner. As the piston moves through one downward stroke and one upward stroke, the engine's crankshaft turns one revolution. An additional downward and upward stroke of the piston completes another revolution of the crankshaft. The piston's four strokes are typically referred to as intake, compression, power, and exhaust. Such engines utilize poppet type intake and exhaust valves which allow a combustable gas mixture to enter the cylinder, and enable burned gases to escape. The poppet valves are held in a normally closed position by a coil spring, and are momentarily forced to opened positions to coincide with the aforesaid strokes or stages of the piston. The opening of the valves is generally achieved by a camshaft having a series of elliptical lobes which, when rotated, push the valves against the urging of the spring. The camshaft is generally coupled to the crankshaft through mechanical systems known as valvetrains which may comprise gears, belts and/or chains, said valvetrains serving to turn the camshaft synchronously with the crankshaft. The camshaft is commonly turned at half the speed of the crankshaft in order that each valve will open once during the four cycles.

Four cycle engines usually do not efficiently transfer torque from the piston to the crankshaft because each power stroke must turn the crankshaft through two complete revolutions and turn the camshaft through one complete revolution. Frictional and inertial forces adversely affect the engine's torque output. Additionally, the moving parts necessary to drive the valvetrain are susceptible to premature wear and replacement. Furthermore, the timing components and camshaft are expensive to manufacture and contribute significantly to the cost of the engine.

Various mechanical movements have earlier been disclosed which convert reciprocal motion to rotational movement. One such mechanical movement is known as the trammel crank gear. The unique feature of the trammel crank gear is that one revolution is produced for four strokes of a reciprocating member.

The trammel crank gear is comprised of:

(a) an elongated action arm having distal and proximal extremities, said distal extremity confined to linear reciprocal movement.

(b) a first sliding block pivotably attached to said proximal extremity, and a second sliding block pivotably attached to the same side of said arm and closer to said distal extremity, said blocks being of identical configuration and adapted to rotate in the same plane parallel to the axis of said arm, (c) a rotating disc having a front surface facing said arm, and an opposed rear surface, said disc having two straight channels recessed from said front surface, traversing the diameter of the disc, and intersecting at right angles at the center of said disc, said channels adapted to accept said sliding blocks and constraining said blocks to reciprocal linear motion as said disc rotates, and (d) an axle perpendicularly emergent from the center of the rear surface of said disc.

It is accordingly an object of this invention to provide a piston driven four cycle internal combustion engine which efficiently transfers torque output from the pistons to the crankshaft.

It is another object of the present invention to provide a piston driven four cycle internal combustion engine having fewer moving parts than conventional engines of this type.

It is a further object of the present invention to provide a piston driven internal combustion engine which is less expensive to manufacture than conventional engines of this type.

These objects and other objects and advantages of the invention will be apparent from the following description.

SUMMARY OF THE INVENTION

The above and other beneficial objects and advantages are accomplished in accordance with the present invention by an improvement to the conventional four cycle piston driven internal combustion engine typically comprised of:

(a) a block having upper and lower surfaces, crankcase cavity having a ceiling and forward and rear bearing apertures centered upon a common lateral axis, at least one cylinder bore communicating between said ceiling and said upper surface, said cylinder bore having a centered secondary axis that perpendicularly intersects said lateral axis, (b) a piston adapted for reciprocating axial motion within said cylinder bore, and having a transversely oriented wrist pin, (c) a cylinder head having upper and lower surfaces, said lower surface abutting the upper surface of said block and covering said cylinder bore, said cylinder head having a circular intake port, circular exhaust port, and threaded spark plug aperture, said ports and aperture communicating between said upper and lower surfaces, (d) poppet intake and exhaust valve means having circular faces adapted to make sealing abutment with said intake and exhaust ports, respectively, said valve means having elongated stems which slideably traverse close-fitting channels penetrating said cylinder head, (e) spring means interactive between said valve means and cylinder head in a manner to bias said valve means toward sealing abutment with its respective port, (f) elongated fulcrum means fixedly associated with said cylinder head, (g) a rocker arm interactive with each fulcrum means in a manner to depress an associated valve stem to displace said valve face from said port, and (h) spark plug means adapted to produce an ignition spark within said cylinder.

The improvement of the present invention is a cylinder assembly comprising:

(i) a trammel crank mechanism of the aforesaid nature wherein the distal extremity of the reciprocating arm is attached to the wrist pin of the piston, said rotating disc adapted to rotate in perpendicularly centered relationship with the axis of said bearing apertures, (j) intake and exhaust cam lobes transversely disposed upon said axle, said lobes having elliptical perimeters and cam lifts defined as the greatest distance extending radially from said axis to the perimeter of said lobe, said intake and exhaust cam lifts disposed approximately 90 degrees apart about said axle, (k) elongated intake and exhaust pushrod means perpendicularly oriented to said axle, said pushrod means having upper and lower extremities, said lower extremities adapted to rest upon said lobes, said upper extremities extending through said cylinder head and interacting with rocker arms, and (l) an elongated crank arm adapted to rotate in coaxial alignment with said disc, said crank arm having front and rear surfaces and connecting and free extremities, said connecting extremity pivotably coupled to said reciprocating arm at a site between said sliding blocks, said free extremity terminating in counterweight means, and a crankshaft perpendicularly emergent from said front surface in coaxial relationship with said disc, whereby (m) a four stroke cycle of said piston produces one revolution of said axle, and said pushrod means operate the poppet valves pursuant to the requirements of said four stroke cycle.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
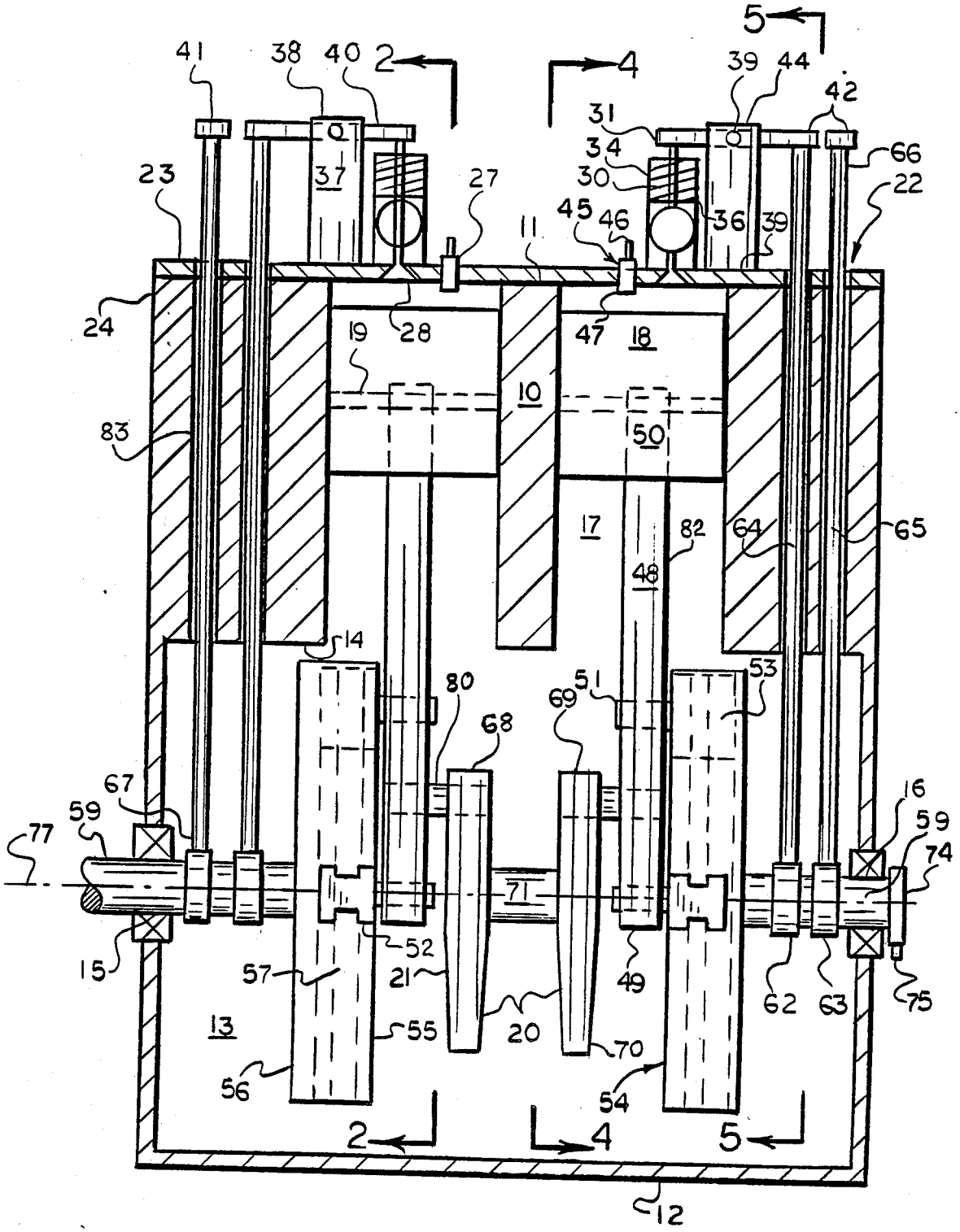
FIG. 1 is a side view of an internal combustion engine showing an embodiment of the improved cylinder assembly of the present invention, two units of said assembly being arranged in front-to-front relationship.

Referring to FIGS. 1-5, an internal combustion engine is shown having two identical cylinder assemblies of the present invention in coupled front-to-front relationship.

Conventional features of the engine include: block 10 having upper and lower surfaces 11 and 12, respectively; crankcase cavity 13 having a ceiling 14 and forward and rear bearing apertures 15 and 16, respectively, centered upon a common lateral axis 77; and cylinder bores 17 communicating between said ceiling and upper surface, and having centered axes 78 that perpendicularly intersect said lateral axis. A piston 18 is adapted for reciprocal axial motion within each bore 17, and has a transversely oriented wrist pin 19.

Cylinder head 22 has upper and lower surfaces 23 and 24 respectively. Lower surface 24 abuts upper surface 11 of the block 10 and covers cylinder bores 17. The cylinder head has, associated with each cylinder bore, a circular intake port 25, circular exhaust port 26 and threaded spark plug aperture 27, said ports and aperture communicating between upper surface 23 and lower surface 24. Popper intake and exhaust valves 28 and 29, respectively, have circular faces 33 adapted to make sealing abutment with ports 25 and 26, respectively. The valves have elongated valve stems 30 which extend to upper extremities 31 disposed above said cylinder head. A coil spring 34, is interactively disposed between upper extremity 31 of the valve stem and upper surface 23 of cylinder head 22.

Fulcrum post 37 extends upwardly from fixed attachment to upper surface 23, and terminates in extremity 38 having pivotal mounting pins 39. As shown more clearly in FIG. 3, intake rocker arm 40 and exhaust rocker arm 41 have front and rear extremities 42 and 43, respectively, and pivot channels 44 which engage pivot pins 39. Front extremities 42 of the rocker arms rest upon the upper extremities 31 of the valve stems. The rocker arms thereby pivot about fulcrum 37 to depress valve stem 30, causing downward displacement of the valves from their respective ports. Spark plug 45 has an upper extremity 46 adapted to receive ignition voltage, and a lower extremity 47 disposed within cylinder bore 17 and adapted to provide an ignition spark.

The illustrated embodiment of FIG. 1 is comprised of two identical cylinder assemblies in front-to-front relationship. The piston and trammel crank of the engine are illustrated at the 357 degree stage of rotation, as further depicted in FIG. 2, Stage A. In the embodiment of Figure 1, the two cylinder assemblies are in fixed synchronization such that ignition occurs in the two cylinders 180 degrees apart about lateral axis 77. The four stroke cycles of the pistons are staggered 180 degrees apart. As one cylinder begins the compression stroke, the other cylinder begins the exhaust stroke. The valve train of the engine is arranged to permit simultaneous upward and downward piston reciprocal movement, yet similar piston movement performs different strokes of the four stroke cycle by virtue of different valve position and ignition firing. In other embodiments, the engine may be comprised of a number of cylinder assemblies oriented in either front-to-front or front-to-rear sequences. Each individual cylinder assembly is comprised of a cylinder bore and associated conventional engine components as described hereinabove, and a trammel crank mechanism 79. Elongated action arm 48, which in conventional engines may be called a connecting rod, has at least one flat side 82 and proximal and distal extremities 49 and 50, respectively. The distal extremity is pivotably joined to wrist pin 19. First sliding block 52 is pivotably attached to proximal extremity 49. Second sliding block 53 is pivotably attached to the same flat side of arm 48 at a site 51 between said proximal and distal extremities.

Rotating disc 54 has a front surface 55 facing flat side 82, and an opposed rear surface 56. The disc has two straight channels 57 and 58 recessed from front surface 55, traversing the diameter of the disc, and intersecting at right angles at the center of the disc. Channel 57 accepts first sliding block 52, and channel 58 accepts second sliding block 53, said blocks fitting in close conformity with their respective channels. In preferred embodiments, the blocks have grooves in their opposed sides which interlock in tracking fashion with aligned tongues inwardly directed from the opposite faces of channels 57 and 58.

Disc 54 is adapted to rotate in perpendicularly centered relationship with respect to lateral axis 77. Axle 59, perpendicularly emergent from the center of rear surface 56 of the disc, extends to journaled engagement with bearing aperture 15 or 16. In alternative embodiments, axle 59 may communicate with other cylinder assemblies.

Intake and exhaust cam lobes 62 and 63, respectively, are transversely disposed upon axle 59. The lobes have elliptical perimeters and cam lifts defined as the greatest distance extending radially from the lateral axis to the perimeter of said lobe. The intake and exhaust camlifts are disposed approximately 90 degrees apart about the axle. Elongated intake and exhaust pushrods 64 and 65, respectively are oriented perpendicularly to axle 59 and are slideably retained by channels 83 in said block. The pushrods have upper and lower extremities 66 and 67, respectively. Lower extremities 67 are adapted to rest upon lobes 62 and 63. Upper extremities 66 extend beyond cylinder head 22 and interact with proximal extremities 42 of rocker arms 40 and 41.

Elongated crank arm 68 has connecting and free extremities 69 and 70 respectively, and opposed first and second surfaces 20 and 21 respectively. A bearing rod 80 pivotably interconnects extremity 69 at second surface 21 with action arm 48 at a site midway between said sliding blocks. Free extremity 70 is formed as a counterweight. As will hereinafter be shown, the cylinder assembly functions in a manner such that the counterweight moves in opposition to movement of the piston. This preserves centrifugal balance about the lateral axis.

Crankshaft 71 is perpendicularly emergent from said first surface 20 upon lateral axis 77, and extends to joinder with the crankshaft of the adjacent cylinder assembly. In alternative embodiments, however, the crankshaft may extend to joinder with the axle emergent from the rear surface of a disc of an adjacent cylinder assembly.

Circular ignition ring 74 is transversely mounted on the extremity of axle 59 and has radially extending switch 75 which is adjustable with respect to the axis of axle 59 and adapted to activate conventional ignition breaker means.

Figure 2:
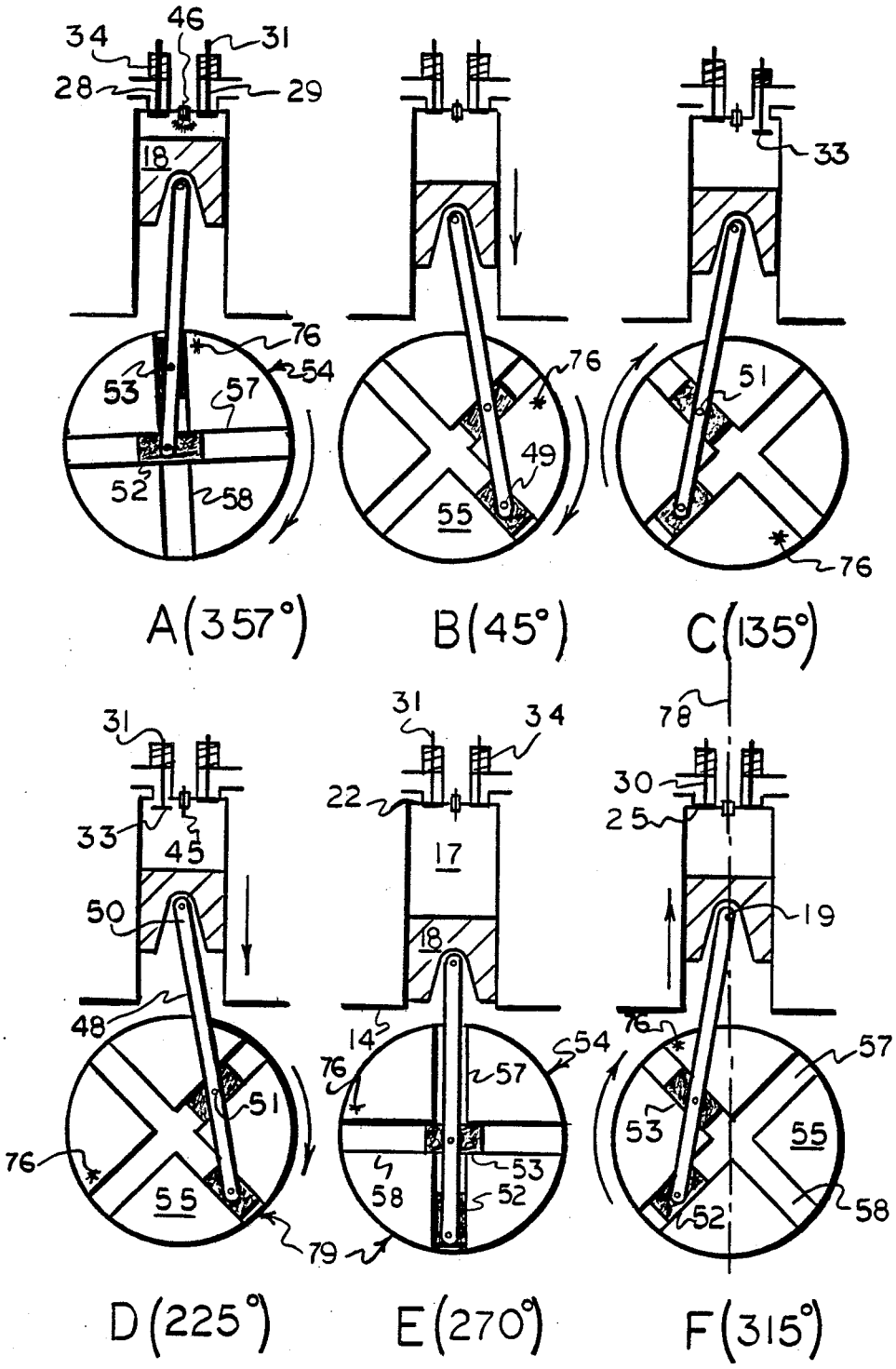
FIG. 2 is a schematic sectional view taken upon the 2—2 line of FIG. 1 illustrating various stages of the crankshaft cycle.
Figure 3:
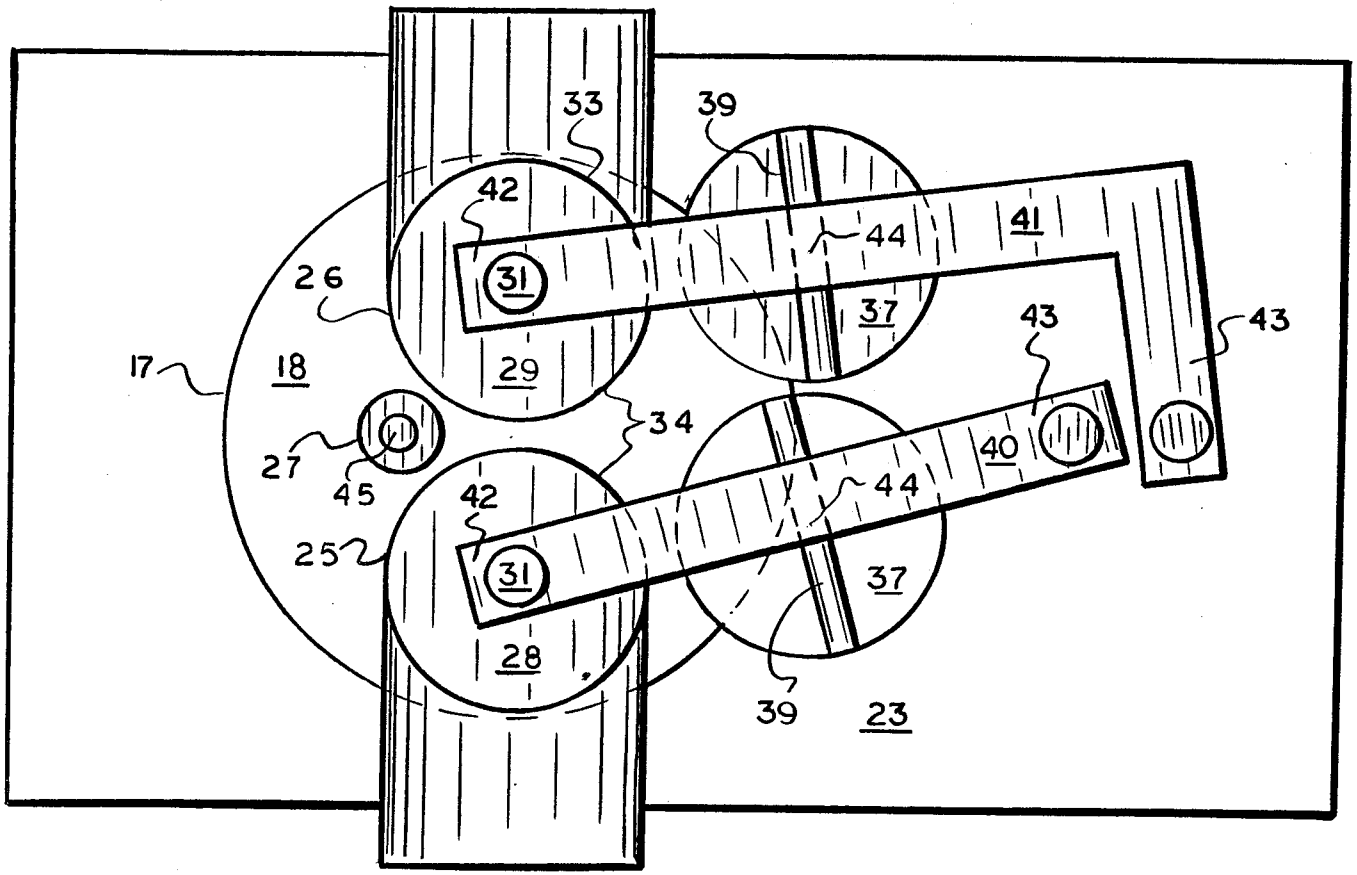
FIG. 3 is a top view of the cylinder assembly on the right side of FIG. 1.
Figure 4:
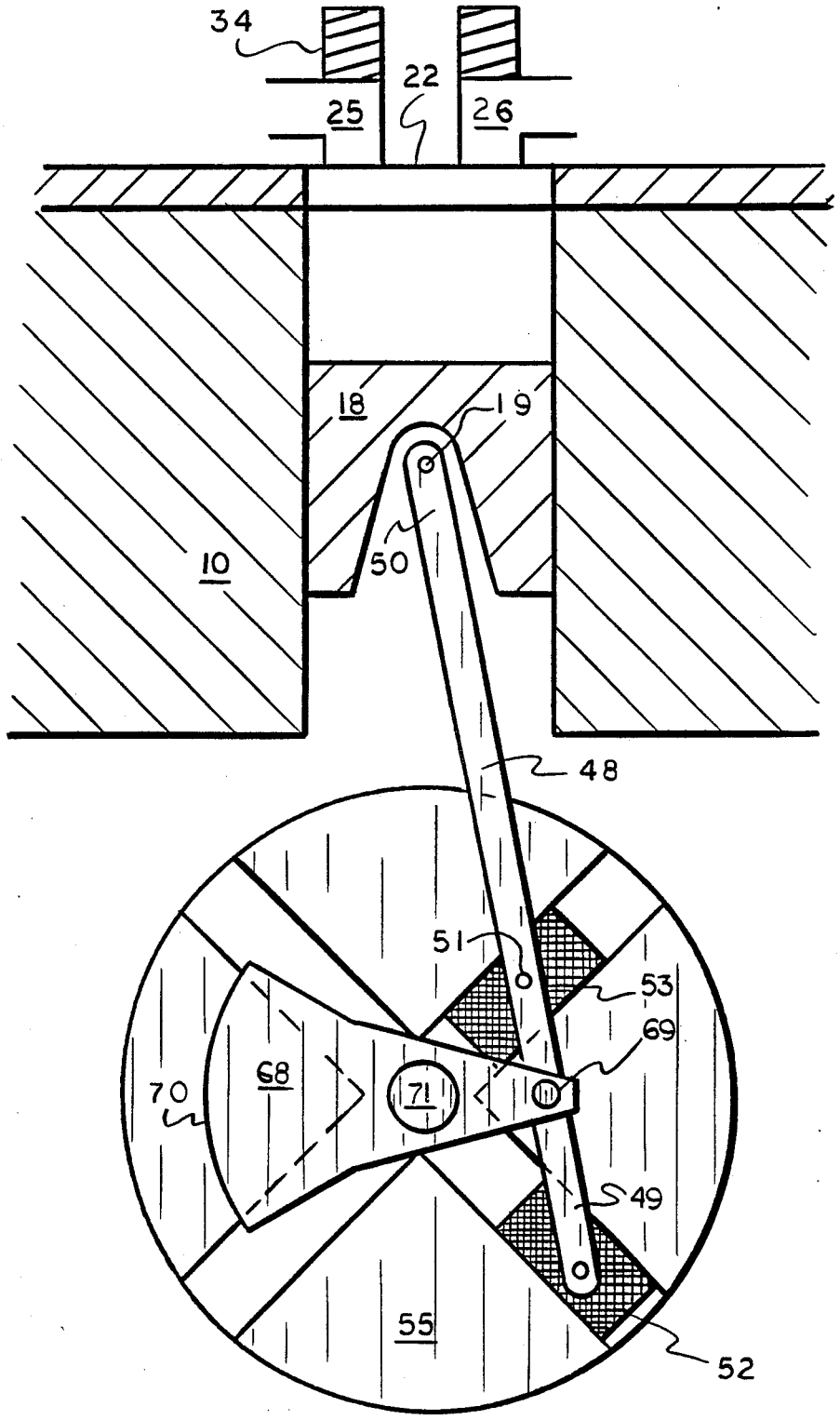
FIG. 4 is a schematic sectional view taken upon the line 4—4 of FIG. 1.
Figure 5:
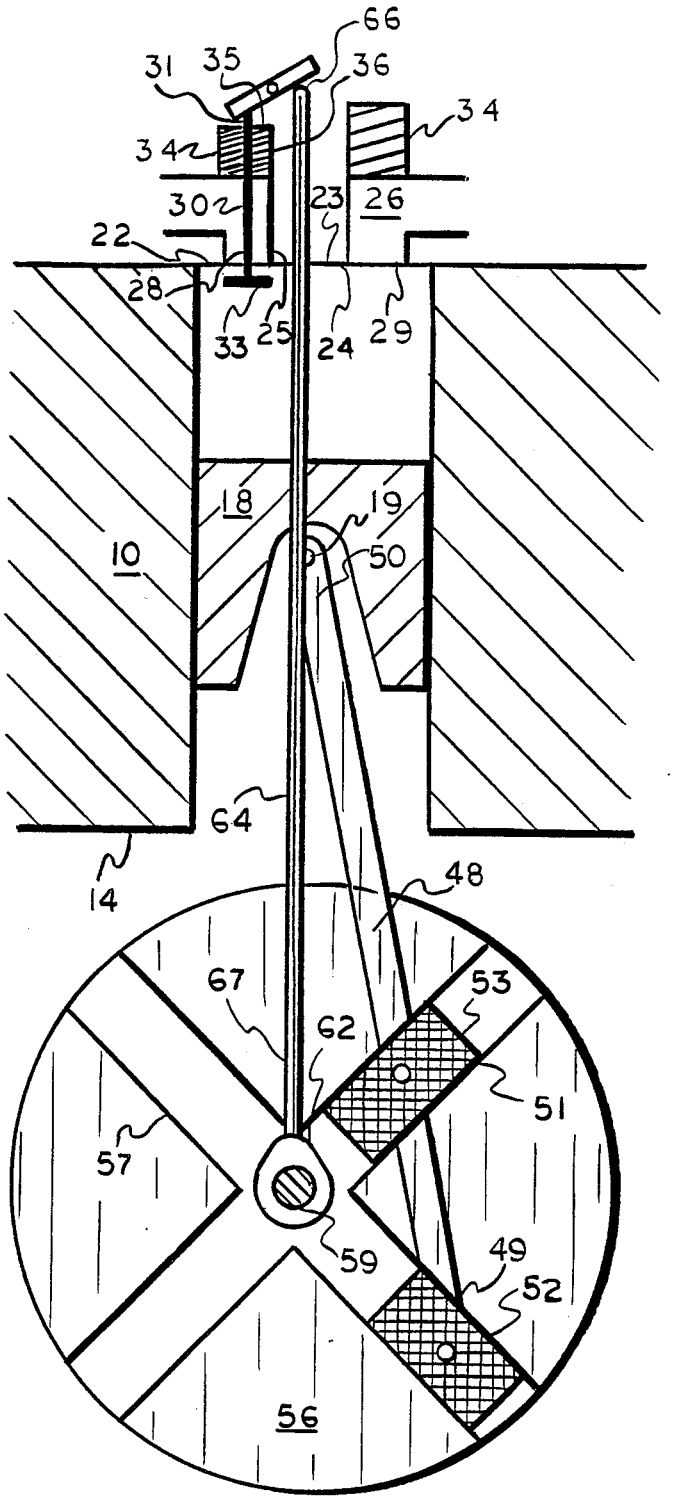
FIG. 5 is a schematic sectional view taken upon the line 5—5 of FIG. 1.

Referring specifically to FIG. 2, six individual stages of the trammel crank cycle are depicted for purposes of illustration. The degrees of rotation associated with each stage are measured about lateral axis 77. The ignition position of disc 54 is depicted in Stage A where piston 18 has almost reached top dead center, and second sliding block 53 is at the top of channel 58. Disc 54 is shown to rotate in a clockwise manner. Timing mark 76 is depicted upon disc 54 to help show the positions of components throughout one complete revolution of the trammel crank cycle. In Stage A, switch 75 enables ignition voltage to travel to the spark plug, which ignites the compressed gas mixture in cylinder 17. Ignition generally occurs just before the piston reaches the 0 degree position, the exact position being adjustable. In preferred embodiments, the timing of the ignition spark may be advanced with respect to the piston's position, especially at high rpm3 s, by means of vacuum or electronic spark advance means. Both valves 28 and 29 remain closed.

Stage B depicts the trammel crank at its 45 degree position. Piston 18 is traveling downward on its power stroke. The power stroke occurs between 0 and 90 degrees of rotation of disc 54. Both valves 28 and 29 are held in closed position by the urging of springs 34. Therefore, the expansion of ignited combustible mixture drives piston 18 downward, thereby turning disc 54 by means of action arm 48, and applying torque to axle 59.

Stage C depicts the trammel crank at its 135 degree position. Piston 18 has begun to move upwardly in its exhaust stroke. The exhaust stroke occurs between 90 degrees and 180 degrees of rotation of disc 54. Exhaust valve 29 has been depressed by rocker arm 41 which has been pivoted by the upward movement of push rod 65 upon exhaust cam lobe 63. Such action allows burned gases to escape cylinder 17 through exhaust port 26 as piston 18 is forced upward by means of action arm 48.

Stage D depicts the intake stroke of piston 18. Disc 54 has rotated to the 235 degree position, drawing piston 18 downwardly by means of action arm 48. The intake stroke occurs between 180 and 270 degrees of rotation of disc 54. Intake valve 28 has been pushed open by means of rocker arm 40, which has been pivoted upward by the movement of push rod 64 upon cam lobe 62. Such action allows a combustible mixture to be drawn through port 25 into cylinder 17.

Stage E depicts disc 54 in the 270 degree position. Piston 18 has here reached its lowermost position. Spring 34 has returned valve 28 to its closed position thereby sealing cylinder 17.

Stage F depicts the trammel crank at the 315 degree position. Piston 18 has begun its upward compression stroke. The compression stroke occurs between 270 degrees and 360 degrees of rotation of disc 54. Both valves remain closed by springs 34, thereby allowing piston 18 to compress the combustible mixture contained in cylinder 17.

By virtue of the aforesaid components and their interaction, it is seen that, for each four-stroke cycle of the piston, the laterally disposed axle moves just one revolution. Also, the engine does not require a conventional cam shaft and valve train to operate the poppet valves.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a four cycle piston driven internal combustion engine whose components comprise:

(a) a block having upper and lower surfaces, a crankcase cavity having a ceiling and forward and rear bearing apertures centered upon a common lateral axis, and at least one cylinder bore communicating between said ceiling and said upper surface, said cylinder bore having a centered axis that perpendicularly intersects said lateral axis, (b) a piston adapted for reciprocating axial motion within said cylinder bore, and having a transversely oriented wrist pin, (c) a cylinder head having upper and lower surfaces, said lower surface abutting the upper surface of said block and covering said cylinder bore, said cylinder head having a circular intake port, circular exhaust port, and threaded spark plug aperture, said ports and aperture communicating between said upper and lower surfaces, (d) poppet intake and exhaust valve means having circular faces adapted to make sealing abutment with said intake and exhaust ports, respectively, said valve means having elongated stems, (e) spring means interactive between said valve means and cylinder head in a manner to bias said valve means toward sealing abutment with its respective port, (f) elongated fulcrum means fixedly associated with said cylinder head, (g) a rocker arm interactive with each fulcrum means in a manner to depress an associated valve stem to displace said valve face from said port, and (h) spark plug means adapted to produce an ignition spark within said cylinder, the improvement comprising:

(i) a trammel crank mechanism interactive with each piston, said trammel crank mechanism comprising:

* an elongated action arm having distal and proximal extremities and at least one flat side, said distal extremity engaging said wrist pin,

** a first sliding block pivotably attached to said flat side adjacent said proximal extremity, and a second sliding block pivotably attached to said side closer to said distal extremity, said blocks being of identical configuration and adapted to rotate in the same plane parallel to said flat side,

*** a disc having a center axis of rotation coinciding with said lateral axis, a front surface facing the flat side of said arm, an opposed rear surface, and two straight channels recessed from said front surface and traversing the diameter of the disc and intersecting at right angles at the center of said disc, said channels adapted to accept and constrain said sliding blocks to reciprocal linear motion as said disc rotates, and

**** an axle perpendicularly emergent from the rear surface of said disc and centered upon said lateral axis, (j) intake and exhaust cam lobes radially emergent from said axle, said lobes having elliptical perimeters and cam lifts defined as the greatest distance extending radially from said axle to the perimeter of said lobe, (k) elongated intake and exhaust pushrod means perpendicularly oriented to said axle, said pushrod means having upper and lower extremities, said lower extremities adapted to rest upon said lobes, said upper extremities interacting with rocker arms, whereby (l) a four stroke cycle of said piston produces one revolution of said axle, and said pushrod means operate the poppet valves pursuant to the requirements of said four stroke cycle.

* * * * *